US009063463B2

(12) United States Patent
Leute

(10) Patent No.: US 9,063,463 B2
(45) Date of Patent: Jun. 23, 2015

(54) SYSTEMS AND METHODS FOR FACILITATING ADVANCED TONER DISPENSING FROM ROTATING TONER CARTRIDGE COMPONENTS

(71) Applicant: XEROX Corporation, Norwalk, CT (US)

(72) Inventor: Gerardo Leute, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 124 days.

(21) Appl. No.: 13/691,693

(22) Filed: Nov. 30, 2012

(65) Prior Publication Data

US 2014/0153970 A1 Jun. 5, 2014

(51) Int. Cl.
*G03G 15/08* (2006.01)
*B01F 9/00* (2006.01)

(52) U.S. Cl.
CPC ..... *G03G 15/087* (2013.01); *B01F 9/0016* (2013.01); *G03G 15/0872* (2013.01)

(58) Field of Classification Search
USPC ..... 399/258, 261, 263; 222/167
See application file for complete search history.

(56) References Cited

U.S. PATENT DOCUMENTS 4,212,264 A * 7/1980 Knechtel et al. ..... 399/261
5,970,290 A * 10/1999 Yoshiki et al. ..... 399/261
6,766,134 B2 * 7/2004 Nakamura ..... 399/258
7,899,369 B2 * 3/2011 Kurogawa ..... 399/258
7,925,184 B2 * 4/2011 Yamada ..... 399/120
8,050,597 B2 * 11/2011 Yoshizawa et al. ..... 399/262
8,244,163 B2 * 8/2012 Yoshizawa et al. ..... 399/262
2001/0008592 A1 * 7/2001 Harris et al. ..... 399/262
2004/0161267 A1 * 8/2004 Ichikawa et al. ..... 399/262

* cited by examiner

*Primary Examiner* — Billy Lactaoen
*Assistant Examiner* — Arlene Heredia Ocasio
(74) *Attorney, Agent, or Firm* — Ronald E. Prass, Jr.; Prass LLP

(57) ABSTRACT

A system and method are provided for improving powder material dispensing from containers, including toner dispensing from rotating toner cartridge components. The disclosed systems and methods separately agitate a rotating toner bottle, including an apparently, or indicated, expended toner bottle, in an image forming device to dislodge residual toner in the toner bottle without the need to remove the toner bottle from the image forming device to perform manual agitation by modifying a physical configuration of the rotating toner bottle in a manner that improves the performance of the rotating toner bottle by improving the flow of the toner material within the toner bottle. The disclosed physical configurations of the rotating toner bottle impart agitating pulses or disturbances onto rotating toner bottles to disturb any layers of residual toner material formed within the rotating toner bottle that may inhibit flow of the toner material in the rotating toner bottle.

6 Claims, 8 Drawing Sheets

SYSTEMS AND METHODS FOR FACILITATING ADVANCED TONER DISPENSING FROM ROTATING TONER CARTRIDGE COMPONENTS

BACKGROUND

1. Field of the Disclosed Embodiments

This disclosure relates to systems and methods for improving powder material dispensing from containers, including toner dispensing from rotating toner cartridge components.

2. Related Art

Certain image forming devices use powdered toner as the marking material for image forming on image receiving substrates. The term "toner" generally refers to a powder used as the marking material in image forming devices such as xerographic image forming devices, laser printers and photocopiers to form printed text and images on image receiving substrates.

Toner is typically packaged in containers of differing sizes, shapes and compositions. These containers are often injection or blow molded container products. The containers may be generically referred to as "toner cartridges." Toner cartridges are often closed containers in which the toner is conveniently packaged for supply to customers and/or end users. The customers and/or end users need never interact directly with the toner itself. The toner cartridges are customer replaceable consumable components that the customers or end-users install as complete replacement units in the image forming devices, which may be opened for access to the toner by the image forming devices once the toner cartridges are installed in the image forming devices.

Image forming devices today include monitoring capabilities for monitoring levels of all consumables, including toner. Upon an indication that any consumable, including toner in a particular toner cartridge, is nearly exhausted, the prudent customer or end-user will procure a replacement consumable component, in this case a toner cartridge, to have it at the ready. In this manner, when the image forming device advises the customer or end-user that the toner is exhausted, the customer or end user need only remove the exhausted component and replace it with a fresh, full component.

One particular configuration of toner cartridges are toner bottles that are generally circular in cross-sectional profile. These toner bottles are particularly configured to be rotated in the image forming device in which they are installed in a manner that causes the toner material contained in the toner bottles to be transported axially toward an opening at dispensing end of the toner bottles. The toner material in the toner bottle is then lifted radially toward an axially central opening in the dispensing end, through which the toner material is transported out of the toner bottle to the image forming device for use.

FIG. 1 illustrates an exploded view of a typically-configured rotating toner bottle system 100 that may be used to supply toner in a conventional image forming device. As shown in FIG. 1, the rotating toner bottle system 100 generally includes a toner bottle body 110 and an endcap 120. As will be described in greater detail below, the toner bottle body 110 and the endcap 120, which are typically combined as the closed rotating toner bottle, each include physical features that promote flow of the toner material contained in the toner bottle to the dispense end, and a dispensing opening 135, through the endcap 120 for the toner bottle.

The particular physical features are shown in exemplary manner in the depiction in FIG. 1. The toner bottle body 110 may include a helical feature 115 molded into the wall of the toner bottle body 110, which is intended to move or push the toner material in the toner bottle in the axial direction "B" toward the dispense end, i.e., the endcap 120 and dispensing opening 135, as the toner bottle is rotated in direction "A."

When the toner material arrives at the endcap 120 at the dispense end of the toner bottle, there are a plurality of surfaces 125 in the endcap 120 of the toner bottle. This plurality of surfaces 125, again as the toner bottle is rotated in direction "A," may be used to lift the toner material and allow the toner material to slide toward the centrally located dispense point, dispensing opening 135, to an image forming material transport conduit 130 in the image forming device.

FIGS. 2A and 2B illustrate graphical examples of the flow behavior for the toner material in the endcap 220 of a rotating toner bottle as the toner bottle-endcap unit is rotated in direction "A." FIGS. 2A and 2B show two positions 200 and 250 respectively of the endcap 220 as it rotates in direction "A." Toner material 240 that has been transported axially in the toner bottle in the manner shown in FIG. 1 into the endcap 220 is lifted by the plurality of surfaces 225. A portion 260 of the toner material 240 lifted by the plurality of surfaces 225 is directed radially (see direction "C") to the centrally located dispense point, dispensing opening 235, to be supplied out of the toner bottle and into the marking engine of the image forming device.

SUMMARY OF DISCLOSED SUBJECT MATTER

Dispensing all of the toner material from a toner bottle can be challenging. Some percentage of the toner material typically adheres to all of the internal surfaces of the toner bottle, as the material is made to flow axially along the walls of the toner bottle to the dispense end (endcap) of the toner bottle, and then from the wall of the toner bottle in the endcap radially to the centrally-located dispense point in the manner depicted in FIGS. 1 and 2 and in the manner described above.

It is actually an observed problem in these types of toner bottles that the toner material, in having to slide across the inside surface of the toner bottle to be transported to the discharge end of the toner bottle, may do so inefficiently. When less than all of the toner material slides across the inside surfaces of the bottle, less that all of the toner material will be available to be dispensed from the toner bottle. This results in the toner material remaining in the toner bottle when the toner bottle is seemingly empty, resulting in waste.

Experience has shown that an image forming device may indicate that all of the toner material in a particular toner bottle has been exhausted when some significant amount of usable residual toner material remains in the particular toner bottle. Simple visual inspection of the toner bottle by a customer or end-user during the process of removal and replacement may confirm that a reasonable amount of residual toner remains in the particular toner bottle. Simple agitation of the particular toner bottle may result in, for example, dislodging the residual toner adhering to all of the internal surfaces of the particular toner bottle to make the residual toner available for use. If the apparently exhausted toner bottle is then reinserted in the image forming device, the residual toner material may be recovered and used by the image forming device.

In view of the above situation in conventional rotating toner bottle image forming devices, it would be advantageous to implement systems and methods by which to separately agitate a rotating toner bottle, including an apparently, or indicated, expended toner bottle, in the image forming device to dislodge residual toner in the toner bottle without the need to remove the toner bottle from the image forming device to perform manual agitation.

Exemplary embodiments of the proposed systems and methods may modify a physical configuration of the rotating toner bottle in a manner that improves the performance of the rotating toner bottle by improving the flow of the toner material within the toner bottle.

Exemplary embodiments may modify the physical configuration of the rotating toner bottle in a manner that imparts agitating pulses or disturbances onto rotating toner bottles, which will, in turn, disturb any layers of residual toner material formed within the rotating toner bottle that may inhibit flow of the toner material in the rotating toner bottle.

Exemplary embodiments may generate agitating pulses or disturbances by a variety of methods centered on changing an external profile of a rotating toner bottle through modifications of the physical structure and/or circular profile of the rotating toner bottle.

Exemplary embodiments may change a shape of an external cross-sectional profile of the rotating toner bottle by adding one or more flat spots or by adding one or more physical protrusions to the rotating toner bottle. These features that adjust the toner bottle profile may be added in a molding process for the toner bottle. Separately, protruding features may be added to the toner bottle body in post-processing/post-formation steps by mechanically or adhesively affixing the features to an outside of the toner bottle body.

Exemplary embodiments may separately, or additionally, add features on an external profile of an endcap of the rotating toner bottle. These added endcap features may be formed in a manner that would interact with, for example, spring loaded latching features in the image forming device that latch, or otherwise secure, the rotating toner bottle in the image forming device during use.

Exemplary embodiments may separately, or additionally, add features on a cooperating structure in the image forming device with which the external profile of the rotating toner bottle interacts. These added features may be fixed or movable.

Exemplary embodiments may include containers that are modified in a manner that promotes automatic agitation of the containers so as to allow a powdered material stuck to the internal walls of the container to be released and to flow within the container, thereby promoting complete dispensing of the powdered material from the container.

Exemplary embodiments may cause pulses and disturbances during routine operation of the rotating toner bottle that loosen up toner material that has been compacted, or that has become attached to the walls of the container, thereby facilitating flow of toner material within the rotating toner bottle to the dispense point.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for improving toner dispensing from rotating toner cartridge components according to this disclosure, will be described, in detail, with reference to the following drawings, in which.

DETAILED DESCRIPTION OF THE DISCLOSED EMBODIMENTS

The systems and methods for implementing improved toner dispensing from rotating toner cartridge components according to this disclosure will generally refer to this specific utility for those systems and methods. Exemplary embodiments described and depicted in this disclosure should not be interpreted as being specifically limited to any particular configuration a rotating toner bottle, cartridge or dispenser, including a plastic or injection molded bottle, cartridge or dispenser. It should be recognized that advantageous use of a unique container configuration that may aid in, in use, emptying of a powdered substance from that container employing devices and methods such as those discussed in detail in this disclosure is contemplated.

The systems and methods according to this disclosure will be described as being particularly adaptable to use in manufacturing and using rotating toner bottles that deliver powdered toner as the image forming material in image forming, printing and/or copying devices. These references are meant to be illustrative only in providing a single real-world utility for the disclosed systems and methods, and should not be considered as limiting the disclosed systems and methods to any particular product or to any particular type of device in which such a product may be used. Any commonly-known processor-controlled image forming device in which the processor directs delivery of toner that includes systems and dispenser configurations that may be adapted according to the specific capabilities discussed in this disclosure is contemplated.

Figure 3A:
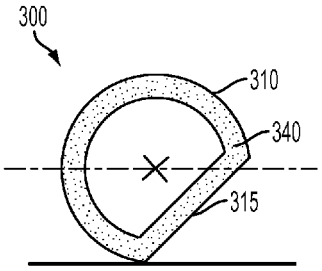
FIGS. 3A and 3B illustrate a first exemplary embodiment of a configuration modification for an external profile of a rotating toner bottle for improving toner dispensing according to this disclosure.
Figure 3B:
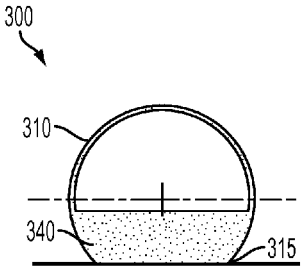

FIGS. 3A and 3B illustrate a first exemplary embodiment 300 of a configuration modification for an external profile of a rotating toner bottle for improving toner dispensing according to this disclosure. As shown in FIGS. 3A and 3B, an external profile of a rotating toner bottle body 310 may be modified to include one or more flat spots 315. The one or more flat spots 315 in the substantially round surface of the toner bottle body 310 may result in a layer of toner 340 that has adhered to an internal wall of the toner bottle body 310 (see FIG. 3A) being dislodged by a disturbance as the toner bottle rotates in the image forming device (see FIG. 3B). The one or more flat spots 315 may be formed or molded into the toner bottle body 310 in the forming or molding process by which the toner bottle body 310 is manufactured.

Figure 4A:
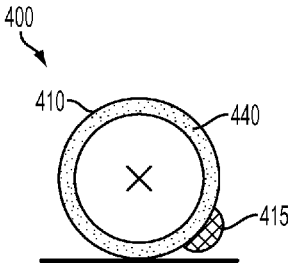
FIGS. 4A-4C illustrate a second exemplary embodiment of a configuration modification for an external profile of a rotating toner bottle for improving toner dispensing according to this disclosure.
Figure 4B:
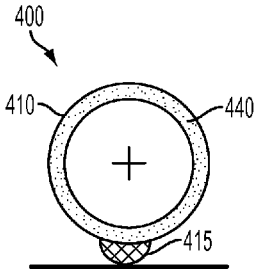
Figure 4C:
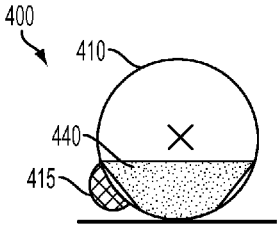

FIGS. 4A-4C illustrate a second exemplary embodiment 400 of a configuration modification for an external profile of a rotating toner bottle for improving toner dispensing according to this disclosure. As shown in FIGS. 4A-4C, an external profile of a rotating toner bottle body 410 may be modified by including one or more external protrusions 415 on the outside of the toner bottle body 410. The one or more external protrusions 415 may be placed in one or more discrete locations along an axial length of the toner bottle body 410, or may extend along substantially an entire axial length of the toner bottle body 410. The one or more external protrusions 415 may "lift" (see FIG. 4B) and "drop" (see FIG. 4C) the toner bottle as it rotates, agitating the toner 440 sufficiently to encourage flow. Multiple external protrusions could be used to allow more than one pulse per rotation. The one or more external protrusions 415 extending from the round surface of the toner bottle body 410 may result in a layer of toner 440 adhering to an internal wall of the toner bottle body 410 (see FIGS. 4A and 4B) being dislodged by a disturbance as the toner bottle rotates in the image forming device (see FIG. 4C). The one or more external protrusions 415 may be formed or molded into the toner bottle body 410 in the forming or molding process by which the toner bottle body 410 is manufactured.

Figure 5A:
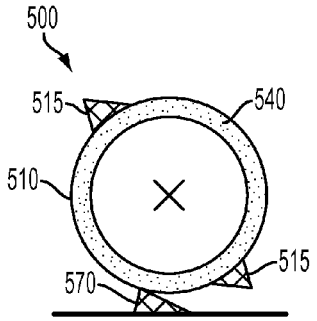
FIGS. 5A-5C illustrate a third exemplary embodiment of a configuration modification for an external profile of a rotating toner bottle that may include fixed or mobile cooperating features on a surface of the image forming device with which the rotating toner bottle interacts for improving toner dispensing according to this disclosure.
Figure 5B:
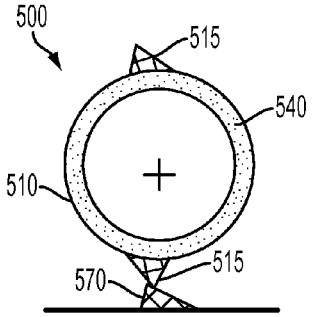
Figure 5C:
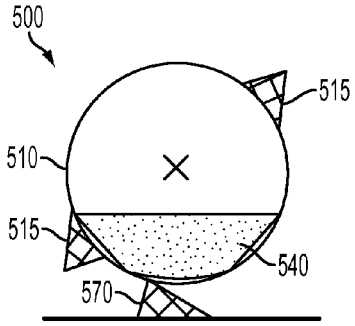
Figure 6A:
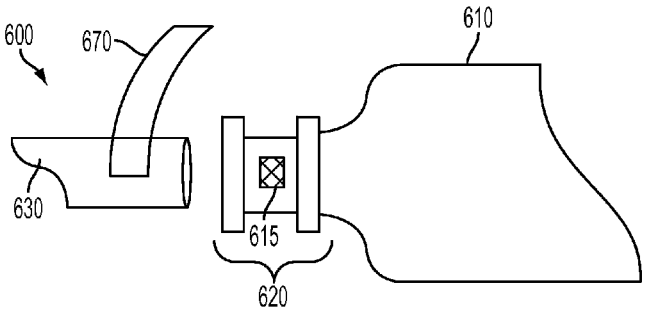
FIGS. 6A-6D illustrate a fourth exemplary embodiment a configuration modification for an external profile of a rotating toner bottle, and specifically an endcap unit, for improving toner dispensing according to this disclosure.
Figure 6B:
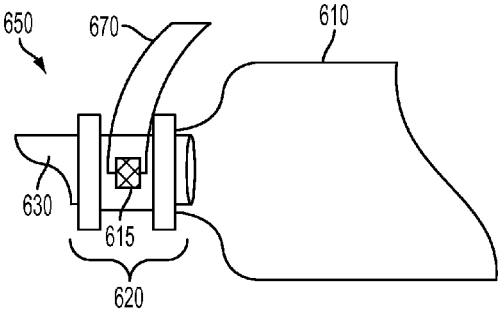
Figure 6C:
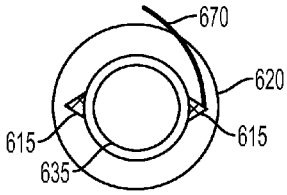
Figure 6D:
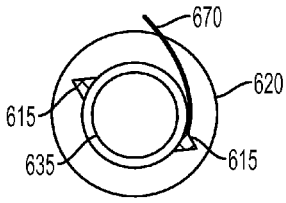

FIGS. 5A-5C illustrate a third exemplary embodiment 500 of a configuration modification for an external profile of a rotating toner bottle that may include fixed or mobile cooperating features 570 on a surface of the image forming device with which the rotating toner bottle interacts for improving toner dispensing according to this disclosure. As shown in FIGS. 5A-5C, an external profile of a rotating toner bottle body 510 may be modified by including one or more external protrusions 515 on the outside of the toner bottle body 510. The one or more external protrusions 515 may be placed in a discrete location along an axial length of the toner bottle body 510, or may extend along an entire axial length of the toner bottle body 510. The one or more external protrusions 515 may "lift" (see FIG. 5B) and "drop" (see FIG. 5C) the toner bottle as it rotates, agitating the toner 540 sufficiently to encourage flow. Multiple external protrusions could be used to allow more than one pulse per rotation. The one or more external protrusions 515 extending from round surface of the toner bottle body 510 may result in a layer of toner 540 adhering to an internal wall of the toner bottle body 510 (see FIGS. 5A and 5B) being dislodged by a disturbance as the toner bottle rotates in the image forming device (see FIG. 5C). The one or more external protrusions 515 may be externally affixed to the toner bottle body 510 by, for example, mechanical structures or adhesives.

In exemplary embodiments, augmenting lifting devices 570 may be provided in the image forming devices. The augmenting lifting devices 570 may be used to provide additional lifting and dropping of the toner bottles to provide greater agitation of the toner 540 in the toner bottle body 510. The augmenting lifting devices 570 may be fixed in the image forming devices. Otherwise, the augmenting lifting devices 570 may be movable, manually or automatically. In certain configurations, the image forming device may signal to the user that the toner in the toner bottle is exhausted. The image forming device may simultaneously, or preliminarily, send a signal to an actuator to move a moveable augmenting lifting device 570 from a normal operating refracted position to an augmenting extended position, as shown in FIGS. 5A-5C. The extension of the movable augmenting lifting device 570 may enhance the agitation effect provided by the protrusions 515 on the outside profile of the rotating toner bottle body 510, the various components appropriately sized to interact for bottle agitation. Otherwise, the image forming device may advise a user to execute a manual extension of the movable augmenting lifting device 570 to exaggerate the agitation effect imparted to the rotating toner bottle in a manner that promoted more complete toner powder movement through and emptying from the rotating toner bottle.

The above-specified exemplary embodiments of modifications in the external profiles of the rotating toner bottles may induce agitation of the toner material in the respective rotating toner bottles by introducing relative movement of one of the other on the rotating toner bottle, or the surface with which the rotating toner bottle interacts in the image forming device with the other of the rotating toner bottle or the surface, as the toner bottle rotates. The modifications may, therefore, create lateral displacement of an axial centerline of the toner bottle as it rotates, or separately cause displacement of a cooperating surface in the image forming device while the axial centerline of the rotating toner bottle remains substantially undisturbed. Either movement will lead to agitation of the toner bottle contents in support of the objectives of the disclosed systems and methods.

It should be noted as well that, although depicted in the above-specified exemplary embodiments as being positioned essentially "under" the respective rotating toner bottles, the cooperating surfaces with which the rotating toner bottles interact may be positioned at any position with respect to the axial centerline of the toner bottle, e.g., "above," "beside," or the like, to facilitate interaction between the modifications on the outer surfaces of the toner bottle bodies and the respective cooperating surfaces in the image forming devices.

Figure 1:
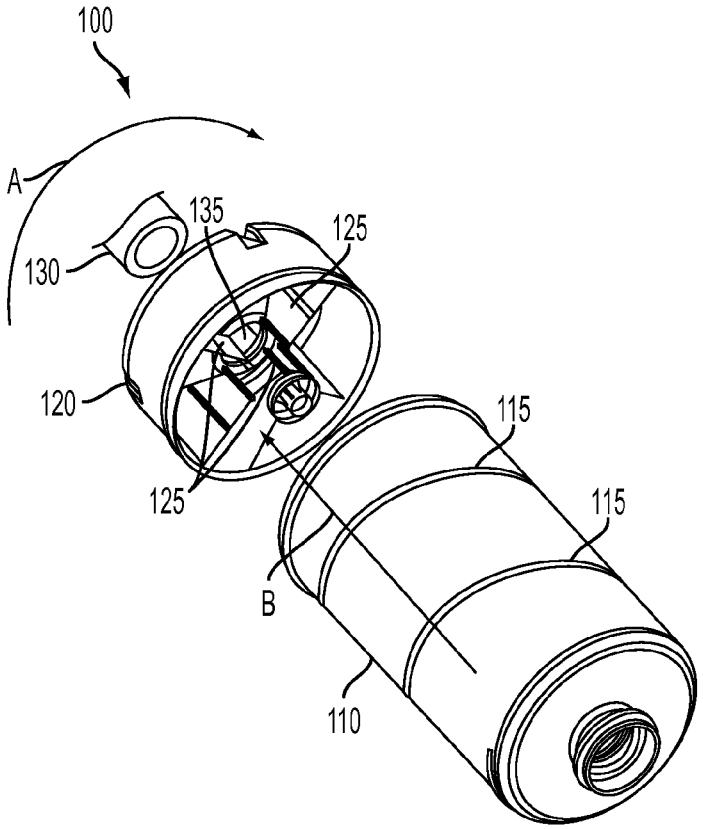
FIG. 1 RELATED ART
FIG. 1 illustrates an exploded view of a typically-configured rotating toner bottle system that may be used to supply toner in a conventional image forming device.
Figure 2A:
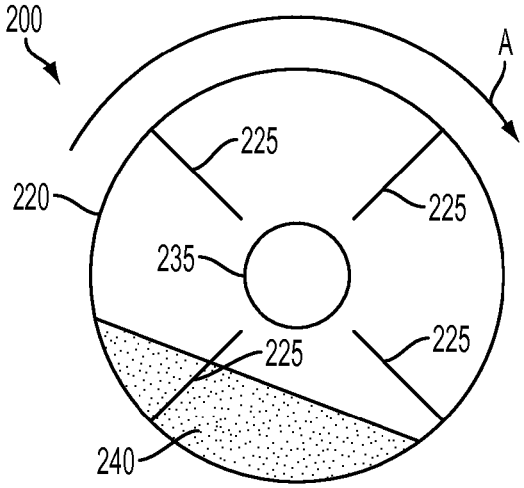
FIGS. 2A and 2B illustrate multiple graphical examples of aspects of the flow behavior for toner material in an endcap of a typically-configured rotating toner bottle.
Figure 2B:
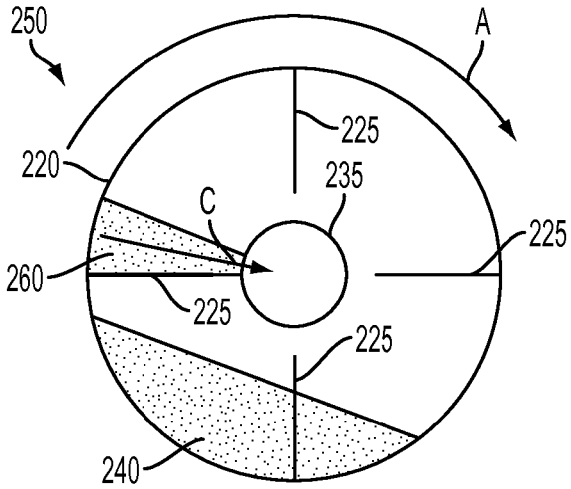

FIGS. 6A-6D illustrate a fourth exemplary embodiment 600 of a configuration modification for an external profile of a rotating toner bottle, and specifically an endcap unit 620, for improving toner dispensing according to this disclosure. As shown in FIGS. 6A-6D, an external profile of an endcap 620 attached to a rotating toner bottle body 610 may be modified by including one or more external protrusions 615 on the outside profile of the endcap 620. The image forming device may include a portal 630 on which the rotating toner bottle may be mounted. See also element 130 in FIG. 1. A lever 670, which may for example be spring loaded with respect to the image forming device, may engage a conforming portion of the endcap 620 to hold the rotating toner bottle in the image forming device. See FIG. 6B. The lever 670 may slide across the endcap 620 of the rotating toner bottle as the toner bottle rotates. The one or more protrusions 615 may be presented in the form of a bump or a ramp, or separately as a dent, in the surface of the endcap 620. The one or more protrusions 615 may be formed in a manner to interact with the lever 670 to, for example, cause the lever 670 to snap up and down generating a tap on the endcap 620 of the rotating toner bottle in a manner that would encourage flow of the material in the rotating toner bottle. See FIGS. 6C and 6D. In embodiments, the respective configurations of the lever 670 and the endcap 620 may be formed in a manner such that the interaction between the lever 670 and the endcap 620 may cause agitation of the rotating toner bottle in the axial direction, which may be beneficial to keeping the toner material in the rotating toner bottle from becoming consolidated or packed. Multiple external protrusions could be used to allow more than one pulse per rotation.

Figure 9A:
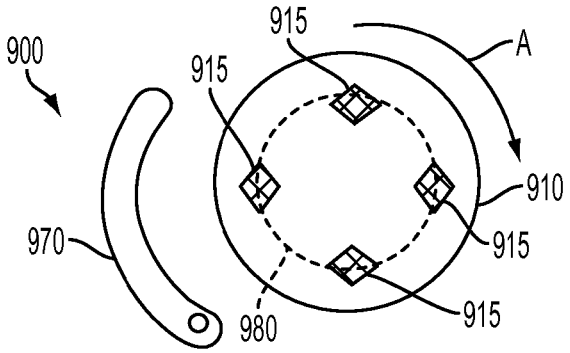
FIGS. 9A-9C illustrate a fifth exemplary embodiment of a configuration modification for an external profile of a rotating toner bottle for improving toner dispensing according to this disclosure.
Figure 9B:
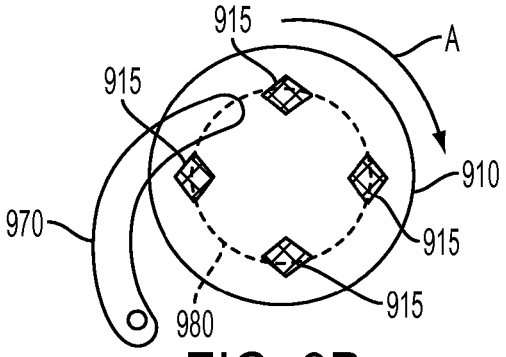
Figure 9C:
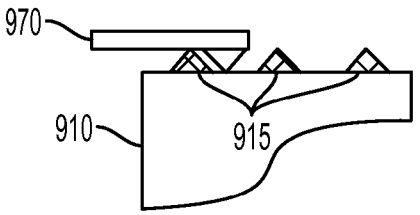

FIGS. 9A-9C illustrate a fifth exemplary embodiment 900 of a configuration modification for an external profile of a rotating toner bottle for improving toner dispensing according to this disclosure. As shown in FIGS. 9A-9C, an external profile of a bottom end of the toner bottle body 910 by including one or more external protrusions 915 on a bottom surface of the bottom end of the toner bottle body 910. Replacement of a rotating toner bottle in an image forming device may be facilitated by a rotating lever 970. The rotating lever 970 may be rotated "out of the way" (see FIG. 9A) to facilitate removal and replacement of the rotating toner bottle. The rotating lever 970 may then be rotated into place (see FIG. 9B) to secure the rotating toner bottle in the image forming device for use. The rotating lever 970 may slide across the bottom surface of the bottom end of the toner bottle body 910, basically on a radius or path 980, as the toner bottle rotates in direction "A" in the image forming device. The one or more protrusions 915 may be presented in the form of a bump or a ramp, or separately as a dent, in the bottom surface of the bottom end of the toner bottle body 910, which are placed substantially on the path 980. The one or more protrusions 915 (or dents) may be formed in a manner to interact with the rotating lever 970, or a protrusion on the rotating lever 970 (see FIG. 9C) to, for example, cause the rotating lever 970 to snap up and down generating a tap on the bottom of the toner bottle body 910 in a manner that would encourage flow of the material in the rotating toner bottle, which may be beneficial to keeping the toner material in the rotating toner bottle from becoming consolidated or packed. Multiple external protrusions could be used to allow more than one pulse per rotation.

Figure 7:
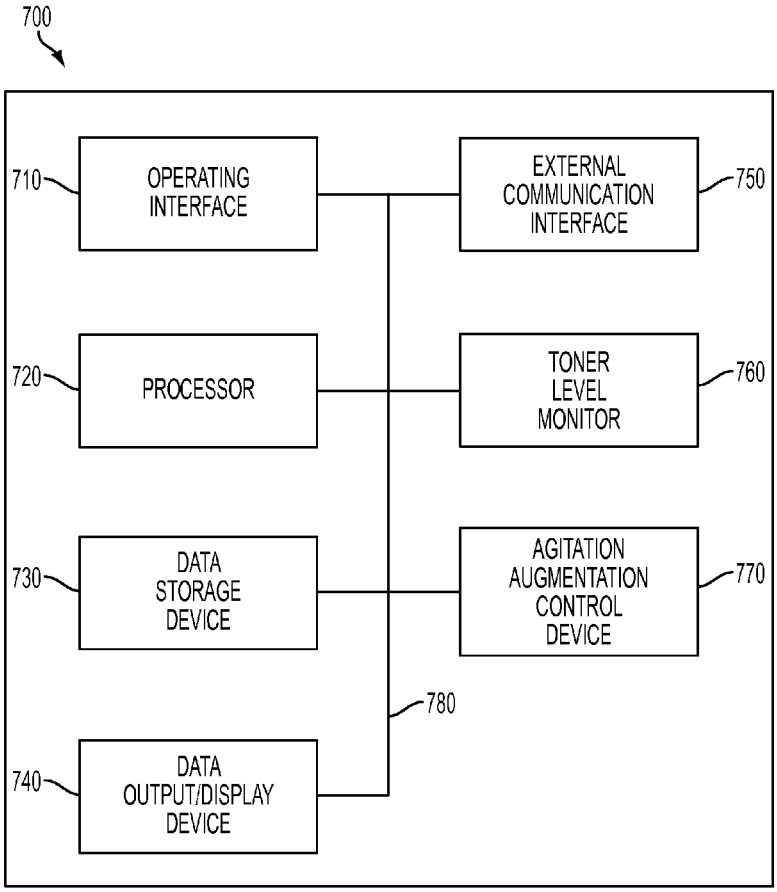
FIG. 7 illustrates a block diagram of an exemplary control system for implementing improved toner dispensing from rotating toner cartridge components according to this disclosure.

FIG. 7 illustrates a block diagram of an exemplary control system 700 for implementing improved toner dispensing from rotating toner cartridge components according to this disclosure.

The exemplary control system 700 may include an operating interface 710 by which a user may communicate with the exemplary control system 700. The operating interface 710 may be a locally accessible user interface associated with an image forming device. The operating interface 710 may be configured as one or more conventional mechanisms common to control devices and/or computing devices that may permit a user to input information to the exemplary control system 700. The operating interface 710 may include, for example, a conventional keyboard, a touchscreen with "soft" buttons or with various components for use with a compatible stylus, a microphone by which a user may provide oral commands to the exemplary control system 700 to be "translated" by a voice recognition program, or other like device by which a user may communicate specific operating instructions to the exemplary control system 700. The operating interface 710 may be a part of a function of a graphical user interface (GUI) mounted on, integral to, or associated with, the image forming device with which the exemplary control system 700 is associated.

The exemplary control system 700 may include one or more local processors 720 for individually operating the exemplary control system 700 and for carrying out operating functions of the toner bottle agitation methodology in an image forming device with which the exemplary control system 700 may be associated. Processor(s) 720 may include at least one conventional processor or microprocessor that interprets and executes instructions to direct specific functioning of the exemplary control system 700.

The exemplary control system 700 may include one or more data storage devices 730. Such data storage device(s) 730 may be used to store data or operating programs to be used by the exemplary control system 700, and specifically the processor(s) 720. Data storage device(s) 730 may be used to store information regarding individual remaining toner schemes for, for example, alerting a user to potential or pending toner exhaustion in one or more toner bottles in an image forming device, as well as for implementing an automated scheme that may extend one or more augmenting lifting devices to facilitate scavenging of residual toner in the toner bottle from one or more internal surfaces in the toner bottle through agitation of the toner bottle. The data storage device(s) 730 may include a random access memory (RAM) or another type of dynamic storage device that is capable of storing updatable database information, and for separately storing instructions for execution of system operations by, for example, processor(s) 720. Data storage device(s) 730 may also include a read-only memory (ROM), which may include a conventional ROM device or another type of static storage device that stores static information and instructions for processor(s) 720. Further, the data storage device(s) 630 may be integral to the exemplary control system 700, or may be provided external to, and in wired or wireless communication with, the exemplary control system 700.

The exemplary control system 700 may include at least one data output/display device 740, which may be configured as one or more conventional mechanisms that output information to a user, including, but not limited to, a display screen on a GUI of the image forming device with which the exemplary control system 700 may be associated. The data output/display device 740 may be used to indicate to a user a status of a supply of toner in one or more monitored toner bottles in the image forming device and also to advise the user as to a status of movable augmenting lifting devices, for example, in the image forming device that may be extended to support increased agitation of a toner bottle that is being indicated as nearly exhausted of its supply of toner.

The exemplary control system 700 may include one or more separate external communication interfaces 750 by which the exemplary control system 700 may communicate with components external to the exemplary control system 700. At least one of the external communication interfaces 750 may be configured as an output port to support connection to, and/or communication with, for example, an image forming device with which the exemplary control system 700 may be associated. Any suitable data connection in wired or wireless communication with an external data repository or external data storage device is contemplated to be encompassed by the depicted external communication interface 750.

The exemplary control system 700 may include at least one toner level monitor 760. The toner level monitor may be associated with sensors in one or more toner bottles in order to provide to the exemplary control system 700 with an indication of a level of toner in the one or more toner bottles. The toner level monitor 760 may operate as a part of a processor 720 coupled to, for example, one or more data storage devices 730, or as a separate stand-alone component module or circuit in the exemplary control system 700. The toner level monitor toner level monitor 760 may provide input to the exemplary control system 700 to advise the user of a near exhausted condition of a toner level in one or more monitored toner bottles. The toner level monitor toner level monitor 760 may send a signal to the data output display device 740 to advise a user that certain action should be taken regarding, for example, replenishment of toner in the one or more exhausted toner bottles, or may send a signal to activate operation of an agitation augmentation control device 770 to, for example, extend one or more augmentation lifting devices as shown in FIG. 5 to supplement agitation that may be imparted to a rotating toner bottle to dislodge residual toner for use according to the discussion above.

All of the various components of the exemplary control system 700, as depicted in FIG. 7, may be connected internally, and to one or more image forming devices by one or more data/control busses 780. These data/control busses 780 may provide wired or wireless communication between the various components of the exemplary control system 700, whether all of those components are housed integrally in, or are otherwise external and connected to an image forming device with which the exemplary control system 700 may be associated.

It should be appreciated that, although depicted in FIG. 7 as an integral unit, the various disclosed elements of the exemplary control system 700 may be arranged in any combination of sub-systems as individual components or combinations of components, integral to a single unit, or external to, and in wired or wireless communication with the single unit of the exemplary control system 700. In other words, no specific configuration as an integral unit or as a support unit is to be implied by the depiction in FIG. 7. Further, although depicted as individual units for ease of understanding of the details provided in this disclosure regarding the exemplary control system 700, it should be understood that the described functions of any of the individually-depicted components may be undertaken, for example, by one or more processors 720 connected to, and in communication with, one or more data storage device(s) 730.

Figure 8:
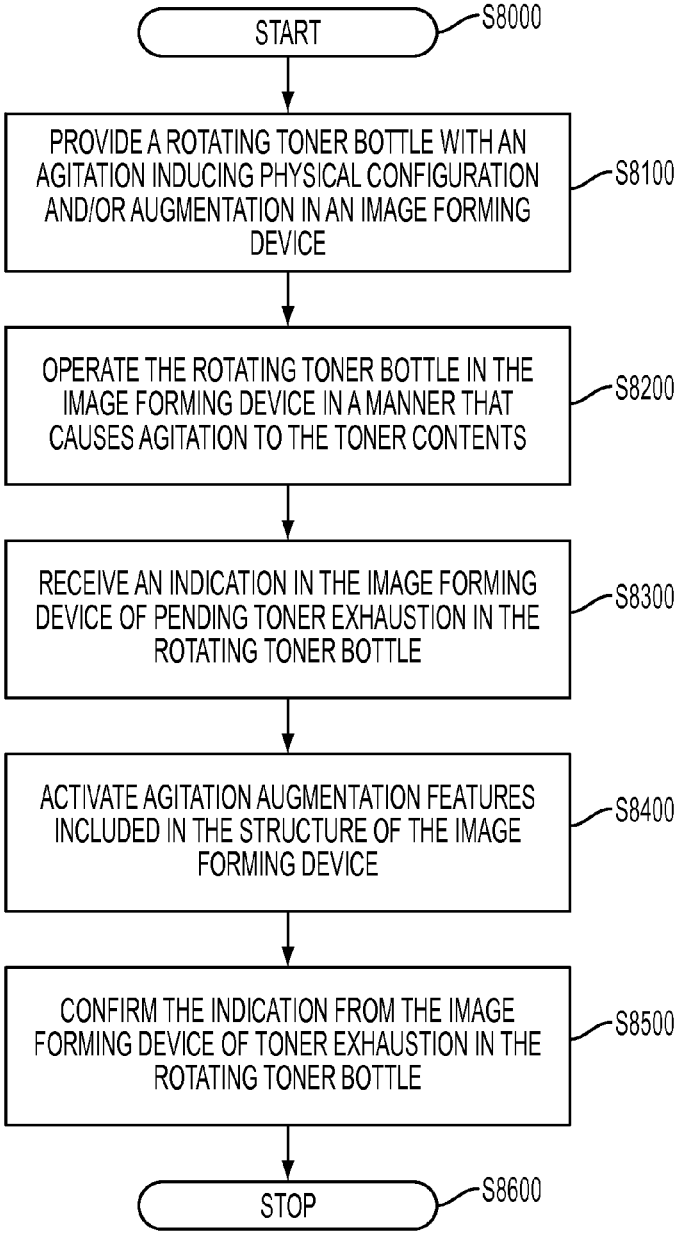
FIG. 8 illustrates a flowchart of an exemplary method for implementing improved toner dispensing from rotating toner cartridge components according to this disclosure.

The disclosed embodiments may include a method for improving powder material dispensing from containers, including toner dispensing from rotating toner cartridge components. FIG. 8 illustrates a flowchart of an exemplary method according to this disclosure. As shown in FIG. 8, operation of the method commences at Step S8000 and proceeds to Step S8100.

In Step S8100, a rotating toner bottle with an agitation inducing physical configuration and/or physical augmentation may be provided in an image forming device. The agitation inducing physical configuration and/or physical augmentation may be according structures such as those shown in any of the exemplary embodiments shown in FIGS. 3-6. Operation of the method proceeds to Step S8200.

In Step S8200, the rotating toner bottle may be continuously or intermittently operated by the image forming device in a manner that induces agitation to the toner bottle and, therefore, to the toner contents of the toner bottle. Operation of the method proceeds to Step S8300.

In Step S8300, an indication may be received in the image forming device regarding pending exhaustion of toner in the toner bottle. Operation of the method proceeds to Step S8400.

In Step S8400, an agitation augmentation feature in the structure of the image forming device may be activated in a manner that enhances the agitation capacity of the rotating toner bottle. Operation of the method proceeds to Step S8500.

In Step S8500, following an agitation or enhanced agitation process based on the inclusion of certain features as described above, an indication of exhaustion of the toner in a rotating toner bottle may be confirmed to the user and the user may then take appropriate action to remove and replace an actually expended rotating toner bottle. Operation of the method proceeds to Step S8600, where operation of the method ceases.

As indicated above, the method may positively provide a previously unachievable level of actual exhaustion of substantially all of the toner in the rotating toner bottle based on a modification of the actual physical configuration of the rotating toner bottle.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable operating and product processing environments in which the subject matter of this disclosure may be implemented for familiarity and ease of understanding. Physical components in this disclosure may be in the form or molded and injection molded structures. Although not required, embodiments of the disclosure may be provided, at least in part, in a form of hardware circuits, firmware, or software computer-executable instructions to carry out the specific functions described. These may include individual program modules executed by a processor.

Those skilled in the art will appreciate that other embodiments of the disclosed subject matter may be practiced in devices, including image forming devices, of many different configurations.

As indicated above, embodiments within the scope of this disclosure may include computer-readable media having stored computer-executable instructions or data structures that can be accessed, read and executed by one or more processors. Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represents one example of a corresponding sequence of acts for implementing the functions described in the steps of the above-outlined exemplary method. The exemplary depicted steps may be executed in any reasonable order to effect the objectives of the disclosed embodiments. No particular order to the disclosed steps of the method is necessarily implied by the depiction in FIG. 8, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

I claim:

1. A rotating container for holding and transporting a powdered material, comprising:

a body section with a substantially round cross-section facilitating the rotating of the container in operation for moving the powdered material axially in the container;

an end cap section at one axial end of the body section through which the powdered material passes to exit the container as the container rotates; and at least one physical feature on an outer profile of the container to induce agitation of the container as the container is rotated, the at least one physical feature comprising a flattening of a portion of the substantially round cross-section of the body section of the container, such that the flattening results from a geometric segment of the substantially round cross-section of the body section being not present.

2. The rotating container of claim 1, further comprising helical features on an internal surface of the body section that facilitate the moving of the powdered material in the axial direction in the body section to the one end of the body section as the container is rotated.

3. The rotating container of claim 1, the flattening of the portion of the substantially round cross-section being formed in the body section of the container during a forming process for the body section.

4. The rotating container of claim 1, the rotating container being a rotating toner bottle for use in an image forming device and the powdered material being image forming toner material.

5. An image forming device, comprising:

an image marking device; and at least one rotating toner delivery container, the at least one rotating toner delivery container, comprising:

a body section with a substantially round cross-section facilitating the rotating of the at least one rotating toner delivery container in operation for moving toner axially through the at least one rotating toner delivery container, an end cap section at one axial end of the body section through which the toner passes to exit the at least one rotating toner delivery container as the at least one rotating toner delivery container rotates, and at least one physical feature on an outer profile of the at least one rotating toner delivery container to induce agitation of the at least one rotating toner delivery container as the at least one rotating toner delivery container is rotated in the image forming device, the at least one physical feature comprising a flattening of a portion of the substantially round cross-section of the body section of the at least one rotating toner delivery container, such that the flattening results from a geometric segment of the substantially round cross-section of the body section being not present;

a toner transport conduit on which the at least one rotating toner delivery container is mounted and about which the at least one rotating toner delivery container rotates in the image forming device; and a holding mechanism that is biased to hold the at least one rotating toner delivery container in place with respect to the toner transport conduit, the end cap section of the at least one rotating toner delivery container being configured to interact with the holding mechanism to hold the at least one rotating toner delivery container in the image forming device as the at least one rotating toner delivery container is rotated.

6. A method for holding and transporting a powdered material in a rotating powdered material container, comprising:

providing a rotating powdered material container having: (1) a body section with a substantially round cross-section facilitating rotating of the powdered material container in operation for moving the powdered material axially in the powdered material container; (2) an end cap section at one axial end of the body section through which the powdered material passes to exit the powdered material container as the powdered material container rotates; and (3) at least one physical feature on an outer profile of the powdered material container to induce agitation of the powdered material container as the powdered material container is rotated, the at least one physical feature comprising a flattening of a portion of the substantially round cross-section of the body section of the powdered material container, such that the flattening results from a geometric segment of the substantially round cross-section of the body section being not present;

rotating the powdered material container in a manner that causes helical features on an internal surface of the body section of the powdered material container to transport at least a portion of the powdered material in an axial direction in the body section to the one end of the body section as the powdered material container is rotated; and inducing agitation of the powdered material in the powdered material container as the powdered material container is rotated by causing the at least one physical feature on the outer surface of the powdered material container to interact with other elements of a device in which the powdered material container rotates.

* * * * *